US006896284B2

(12) United States Patent
Kruajitch

(10) Patent No.: US 6,896,284 B2
(45) Date of Patent: May 24, 2005

(54) DEVICE FOR RAISING A SKI BINDING

(75) Inventor: André Jean Kruajitch, La Buisse (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 10/102,489

(22) Filed: Mar. 20, 2002

(65) Prior Publication Data

US 2002/0135157 A1 Sep. 26, 2002

(30) Foreign Application Priority Data

Mar. 20, 2001 (FR) ..... 01 03737

(51) Int. Cl.[7] ..... A63C 9/18
(52) U.S. Cl. ..... 280/607; 280/11.14; 280/618
(58) Field of Search ..... 280/607, 602, 280/601, 11.14, 616, 617, 618, 634, 636, 635

(56) References Cited

U.S. PATENT DOCUMENTS

| | | | | | |
|---|---|---|---|---|---|
| 5,129,668 | A | * | 7/1992 | Hecht | 280/607 |
| 5,395,132 | A | | 3/1995 | Abondance | |
| 5,480,175 | A | * | 1/1996 | Astier et al. | 280/607 |
| 5,492,356 | A | * | 2/1996 | Astier et al. | 280/607 |
| 5,513,872 | A | * | 5/1996 | Arduin et al. | 280/607 |
| 5,636,855 | A | * | 6/1997 | Couderc et al. | 280/602 |
| 5,647,605 | A | * | 7/1997 | Arduin | 280/607 |
| 5,671,939 | A | * | 9/1997 | Pineau | 280/607 |
| 5,704,628 | A | | 1/1998 | Boehm | |
| 5,758,894 | A | | 6/1998 | Maggiolo | |
| 5,845,923 | A | * | 12/1998 | Zanco | 280/607 |
| 5,915,719 | A | * | 6/1999 | Bauviois | 280/607 |
| 6,193,262 | B1 | * | 2/2001 | Silva | 280/607 |
| 6,217,055 | B1 | * | 4/2001 | Silva | 280/607 |
| 6,227,558 | B1 | * | 5/2001 | Arduin et al. | 280/611 |
| 6,244,616 | B1 | * | 6/2001 | Arduin et al. | 280/602 |
| 6,283,493 | B1 | * | 9/2001 | Arduin et al. | 280/617 |
| 6,412,807 | B1 | * | 7/2002 | Arduin et al. | 280/607 |
| 6,513,826 | B1 | * | 2/2003 | Hangl | 280/602 |
| 6,581,956 | B2 | * | 6/2003 | Kruajitch | 280/618 |
| 6,616,171 | B2 | * | 9/2003 | Kruajitch | 280/607 |

FOREIGN PATENT DOCUMENTS

| | | |
|---|---|---|
| EP | 0 719 166 A | 7/1996 |
| EP | 0 835 675 A2 | 4/1998 |
| FR | 2 777 792 A1 | 10/1999 |
| FR | 2 800 623 A | 5/2001 |

* cited by examiner

*Primary Examiner*—Christopher P. Ellis
*Assistant Examiner*—Jeff Restifo
(74) *Attorney, Agent, or Firm*—Bugnion S.A.; John Moetteli

(57) ABSTRACT

Device for raising the elements (12, 44) of a ski binding consisting of two platforms (1, 4) articulated together in a median zone of the device. One of the platforms (4) has an extension (5) extending beyond the axis of articulation (7) of the platforms, via which extension a part of the force exerted by the skier on the binding may be applied to the ski in the median zone of the binding so as to improve grip and behavior of the ski during a turn.

10 Claims, 2 Drawing Sheets

DEVICE FOR RAISING A SKI BINDING

BACKGROUND OF THE INVENTION

The invention relates to a device for raising the elements of a ski binding comprising a front binding element and a rear binding element, which device consists of two platforms articulated together in the median zone of the device between the binding elements about an axis transverse to the longitudinal axis of the device, the front binding element being fitted on one of the platforms and the rear binding element being fitted on the other platform, the platforms having means for linking to the ski.

It is known to use raising platforms for raising the boot relative to the ski, particularly for competition when the ski used is relatively sharply waisted and it is necessary to prevent the boot from coming into contact with the snow when entering a turn. These platforms are also generally designed so as to provide a degree of decoupling of the ski in the region of the ski binding.

A binding consisting of two platforms articulated together is known from patent application EP 0 835 675, the content of which is incorporated by reference. Its object is to modify as little as possible the flexing characteristics of the ski in the region of the binding. Each of the platforms is fixed to the ski at two points located between the articulation and the zone of the platforms carrying the elements of the ski binding. On either side of the fixing screws, the platforms extend over the skis with a space, it being possible for this space to be filled with an elastic body.

U.S. Pat. No. 5,758,894, the content of which is incorporated by reference, also discloses a raising device consisting of two platforms, each extending as far as the end of the other platform and intersecting in a vertical plane, one of the ends of the platforms being fixed while the other end is held on the ski so as to be able to slide longitudinally relative to the ski. The aim of this construction is to, at all times, maintain the relative position of the center of gravity of the boot relative to the ski and thus to preserve optimum control of the ski. The aim of the construction is also to absorb the vertical stresses applied to the skis.

Other types of raising platforms have also been proposed, but these act as stiffeners so as to further increase the rigidity and stiffness of the ski, particularly in the underfoot zone. U.S. Pat. No. 5,704,628, the content of which is incorporated by reference, discloses, in particular, a raising platform which includes an arm which makes it possible to transmit a part of the forces exerted by the skier in a longitudinal vertical plane to a zone of the ski located in front of the front stop, i.e. in front of the front binding element. The arm is connected to a takeup piece integral with the ski so that a longitudinal force is exerted on the ski between the front stop and the takeup piece in order to generate stiffening.

In another type of platform, such as that described in document FR 2 777 792, the content of which is incorporated by reference, a raising plate rests on flexible strips which extend to the front and to the rear of the zone for fitting the ski binding elements and bear on the upper face of the ski via damping studs. By virtue of the flexibility of the longitudinal strips, such a device does not allow transmission of sufficiently effective bearing forces, particularly when the skier exerts forces in the region of one of the elements of the ski binding. Moreover, the presence of elastomeric studs tends to damp the behavior of the ski overall, so such devices are intended more for relatively forgiving skis, as opposed to highly dynamic skis used particularly in competition.

In patent application FR 00 06335, the content of which is incorporated by reference, in the name of the applicant (not published) a raising device is proposed which allows optimum transmission of the bearing forces exerted by the skier toward the ski. To this end, one of the elements of the ski binding is fitted on the articulated element, one end of which comes into upper contact with the ski via an anchoring means, such that the forces exerted in a vertical plane over the ski binding element are partly transmitted to the ski by this anchored end.

In one embodiment, a part of the forces exerted by the skier in the region of the front stop of the binding are applied onto the ski in front of the front stop, i.e. over a longer zone of the underfoot zone, which allows effective initiation of a turn and better controlled behavior of the ski, particularly in giant slalom.

According to another embodiment, a part of the forces exerted by the skier in the region of the front stop of the binding are also applied to the ski in front of the front stop, but tend to very slightly lift the ski, i.e. they tend to shorten the zone of application of the pressure exerted by the ski on the snow. The effect of this is to facilitate the linking of turns.

SUMMARY OF THE INVENTION

The object of the invention, also, is to optimize transmission of the bearing forces exerted by the skier so that the forces are applied not only to the zones located on either side of the ski binding elements, but also in the median zone of the raising device.

The device according to the invention is defined in that one of the platforms has an extension extending beyond the articulation axis, via which extension the platform can exert a force on the ski when a force is exerted by the skier in a vertical plane over the binding element carried by the platform having said extension.

The platform which has the extension will generally be the platform carrying the rear binding element, i.e. the heelpiece. Thus, when the skier exerts forward flexing in order to initiate a turn, a part of the forces exerted by the skier on the heelpiece will be applied to the ski via the end of the extension, in front of the mid-point of the underfoot zone. This will enable the skier to increase the bearing force in the front part of the underfoot zone and of the ski, i.e. to have better edge gripping upon initiating a turn. In the mid-phase and end-phase of a turn, the rear force will be better distributed over the ski and a part of the force will be transferred under the foot, thereby enhancing grip and the behavior of the ski during a turn.

This transmission of a part of the forces exerted on one of the elements of the ski binding at a point located in front of or behind this binding element takes place here without recourse to platform extensions, toward the front and/or toward the rear, outside the zone carrying the front stop and the heelpiece.

According to one embodiment, the articulation has play in the longitudinal direction of the device.

According to embodiments, one of the platforms has parallel arms extending toward the platform which has the extension, via which arms the platforms are articulated. These arms may be either attached to the platform or made as a single piece together with the platform.

According to one embodiment, the arms are articulated on the platform which carries them with a limited angular play.

Preferably, the platform which has said extension rests on the ski only via zones located at its ends.

The ends of the platforms advantageously have hollows in the bottom of which are formed oblong holes, for the passage of screws for fixing to the ski and the device also comprises sleeves that can be nested in the hollows and which are equipped with a circular screw-passage hole, these sleeves being arranged at the ends of the platforms that it is desired to connect to the ski without the possibility of longitudinal displacement. It is thus possible to choose which end of the platform one wishes to fix to the ski without longitudinal play.

The appended drawing shows, by way of example, one embodiment of the invention and a variant embodiment thereof.

DESCRIPTION OF THE PREFERRED EMBODIMENTS

Figure 1:
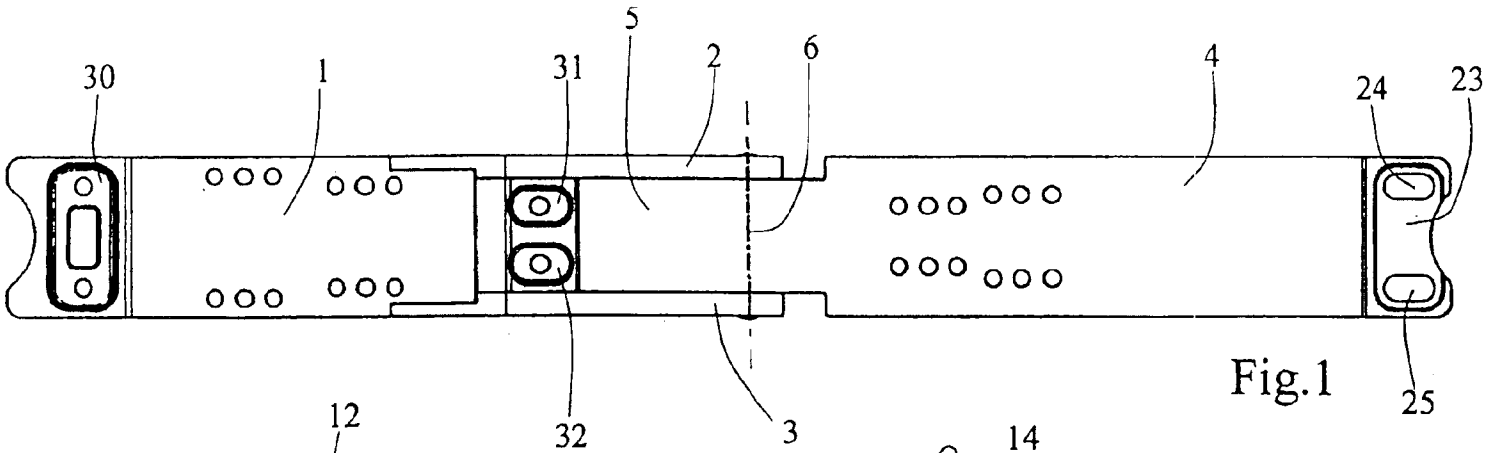
FIG. 1 is a plan view of the raising device, without the elements of the ski binding.
Figure 2:
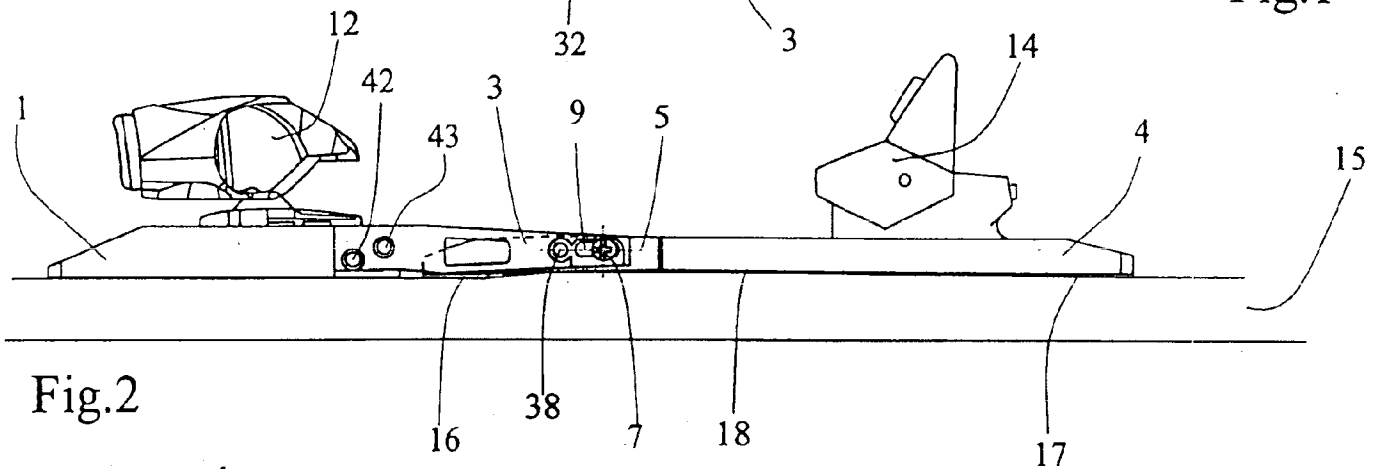
FIG. 2 is a view in elevation of this same device, on a smaller scale and with the ski binding elements.
Figure 3:
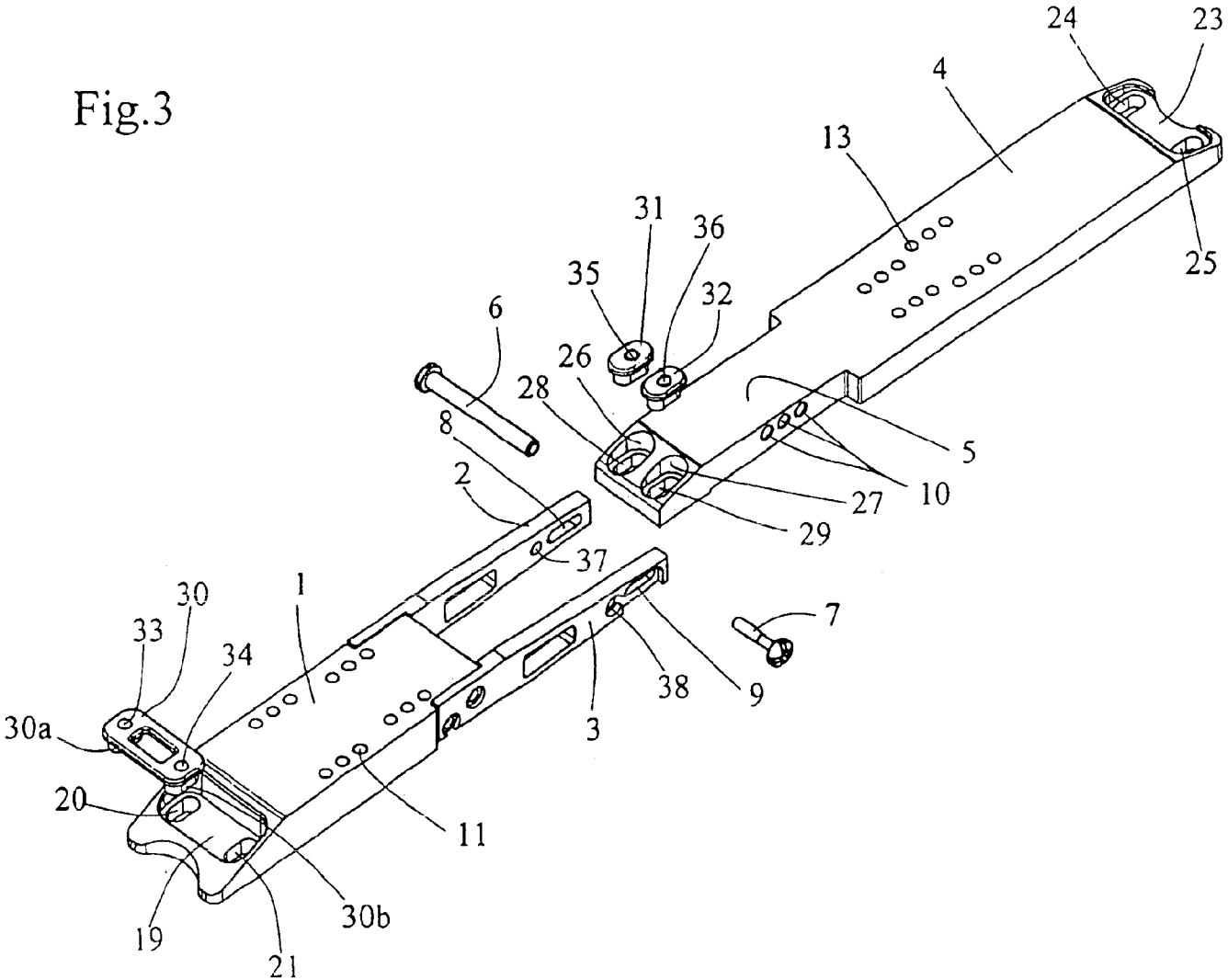
FIG. 3 is an exploded view of FIG. 1.

The raising device shown in FIGS. 1 to 3 comprises a front platform 1 extended toward the rear by two parallel arms 2 and 3 fixed on the sides of the front platform by means of two rivets 42, 43, and a rear platform 4 which has an extension toward the front 5 of narrower width than the width of the platform 4 so that it can be engaged between the arms 2 and 3, the rear platform 4 being articulated to the arms 2 and 3 via its extension 5. The articulation is achieved by a pin 6 held by a screw 7 which can be screwed into the end of the pin 6. The pin 6 traverses the arms 2 and 3 via two apertures 8 and 9 extending longitudinally in the direction of the arms, and the platform 4 via one of the three holes 10 formed in the part 5. The articulation pin is close to the boot. The platform 1 has three systems of threaded holes 11 for fixing the front ski binding element, which consists of a front stop 12, in three different positions. Similarly, the rear platform 4 has three sets of threaded holes 13 for fixing a rear ski binding element or heelpiece 14 in three different positions.

The platforms 1 and 4 and also the sleeves are preferably made from filled polyamide, and the arms 2 and 3 from aluminum. The arms 2 and 3 could, however, be made as a single piece by molding together with the platform 1.

As may be seen in FIG. 2, the raising device is shown as fitted on a ski 15, and the rear platform 4 rests on the ski 15 only in small zones 16 and 17 located at its ends. Between these zones, the lower face 18 of the platform 4 is slightly concave.

At the front, the platform 1 has a rectangular hollow 19, in the bottom of which are formed two oblong holes 20, 21 extending parallel to the longitudinal axis of the device, i.e. of the ski 15. These holes 20 and 21 serve for linking the platform 1 to the ski 15. At its rear end, the rear platform 4 has a rectangular hollow 23 which is identical to the hollow 19, and in the bottom of this hollow 23 are formed two oblong holes 24 and 25 which are identical to the holes 20 and 21 for linking this end of the platform 4 to the ski by means of two screws. The end of the extension 5 has two oblong hollows 26 and 27 located side by side and extending parallel to the longitudinal axis of the raising device. The bottom of these hollows 26 and 27 has oblong holes 28 and 29 identical to the holes 24 and 25, leaving a space between the holes and the hollows 26 and 27.

If the platforms 1 and 4 are secured by means of screws inserted with no addition into the holes 20, 21, 24, 25, 28, 29, it will be observed that the platforms may both be displaced longitudinally on the ski. In point of fact, it is necessary for one of the ends of the platforms to be fixed to the ski without it being possible for it to be displaced. To this end, there are arranged, in the hollows of the ends of the platforms it is desired to fix to the ski without the possibility of displacement, sleeves such as the sleeves 30, 31 and 32 which have circular screw passages 33, 34, 35, 36 allowing the screws to pass without play. The sleeve 30 is in fact a double sleeve formed of two sleeves 30*a* and 30*b*, the profile of which corresponds to the shape of the oblong holes 20 and 21, and 24 and 25, so that it can nest without play in the holes 20 and 21, or 24 and 25. Similarly, the sleeves 31 and 32 have a shape corresponding to the shape of the holes 28 and 29 so that it is possible to nest them without play in these holes 28 and 29.

In the example shown in FIG. 1, the double sleeve 30 is used at the front of the platform 1, and the two sleeves 31 and 32 are in place at the end of the extension 5. The rear link of the platform 4 may be displaced longitudinally relative to the ski, while the arms 2 and 3 may be displaced relative to the ski by means of the apertures 8 and 9.

It is, however, possible to release the front end of the platform 1 by dispensing with the double sleeve 30, and to fix the arms 2 and 3 to the ski. To this end, the arms 2 and 3 have, behind the apertures 8 and 9, cylindrical holes 37 and 38 for the passage of the pin 6.

It is also possible to fix the rear of the rear platform 4 to the ski by placing the double sleeve 30 in the hollow 23. In this case, the sleeves 31 and 32 are not used.

The various choices for releasing the front and rear platforms make it possible to modify the behavior of the ski but, in all cases, a part of the force exerted by the skier in a longitudinal vertical plane over the heelpiece 14 results in the creation of a bearing force on the ski in the bearing zone 16 of the extension 5 in front of the articulation pin of the platforms.

Figure 4:
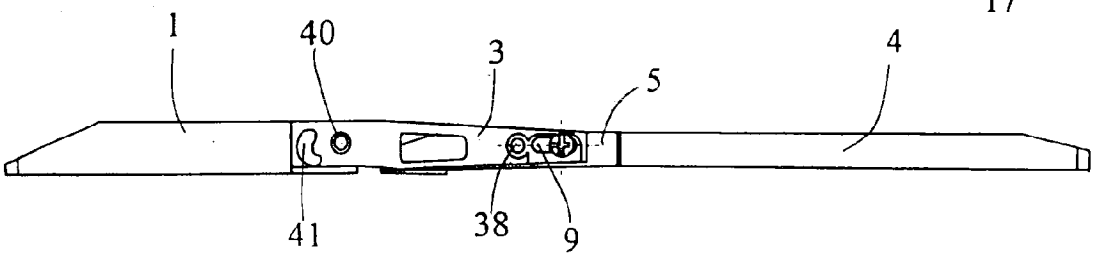
FIG. 4 illustrates a variant embodiment with articulated arms.

According to a variant embodiment shown in FIG. 4, the arms 2 and 3 are articulated by a limited angle on the platform 1. To this end, the arms 2 and 3 are articulated to the platform via a single rivet 40, and they also have an aperture 41 in the shape of an arc of a circle in which the corresponding end of a pin or of a rivet is engaged This link of the arms 2 and 3 to the platform 1 has the effect of further decoupling the ski in the region of the binding.

It is possible to exchange the positions of the front and rear platforms, i.e. to fix the arms 2 and 3 on the rear platform and to extend the front platform between these arms.

Instead of passing between two arms, such as the arms 2 and 3, the extension of one of the platforms could be engaged under the other platform.

The platforms could be extended beyond their links to the ski by parts having no direct contact with the ski.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed:

1. A device for raising elements of a binding of a ski, comprising a front binding element and a rear binding element, which device having two platforms articulated together in the median zone of the device between the binding elements about an articulation axis transverse to the longitudinal axis of the device, the front binding element being fitted on one of the platforms and the rear binding element being fitted on the other platform, the platforms having means for linking to the ski, wherein a first platform has an extension rigidly affixed thereto and extending in a direction away from the binding element which is fitted thereto, substantially beyond the articulation axis, to support a force-application zone by which the extension can exert a force on the ski when a force is exerted by the skier in a vertical plane over the binding element carried by the first platform.

2. The device as claimed in claim 1, wherein the first platform which has the extension is the platform carrying the rear binding element.

3. The device as claimed in claim 2, wherein a second platform has two parallel arms extending toward the first platform and articulated to said extension.

4. The device as claimed in claim 1, wherein a second platform has two parallel arms extending toward the first platform and articulated to said extension.

5. The device as claimed in claim 4, wherein the arms are made in a single piece together with the platform.

6. The device as claimed in claim 4, wherein the arms are also articulated at a limited angle on the second platform.

7. The device as claimed in claim 1, wherein the articulation has a substantial amount of play in the longitudinal direction of the device.

8. The device as claimed in claim 7, wherein the arms have longitudinal apertures traversed by the articulation axis.

9. The device as claimed in claim 1, wherein the platform has the extension having the force-application zone.

10. The device as claimed in claim 1, wherein the platforms are connected to the ski via their ends such that one of their ends can be displaced longitudinally relatively to the ski during flexing of the ski, wherein the bottom of the ends of the platforms have recesses in the form of oblong holes, and wherein the device also comprises sleeves that can be nested in the recesses and which are equipped with a circular screw-passage hole, these sleeves being arranged at the ends of the platforms and fixed, without play, to the ski.

* * * * *